US005958210A

United States Patent [19]

Siu et al.

[11] Patent Number: 5,958,210

[45] Date of Patent: *Sep. 28, 1999

[54] EFFICIENT ELECTROWINNING OF ZINC FROM ALKALINE ELECTROLYTES

[75] Inventors: Stanley C. Siu, Castro Valley; James W. Evans, Piedmont, both of Calif.

[73] Assignee: The Regents of the University of California, Oakland, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/749,365

[22] Filed: Nov. 21, 1996

[51] Int. Cl.[6] ..... C25C 1/16; C25D 5/00; C25D 7/00; C25D 5/20

[52] U.S. Cl. ..... 205/602; 205/603; 205/144; 205/145; 205/148

[58] Field of Search ..... 205/144, 145, 205/148, 602, 603

[56] References Cited

U.S. PATENT DOCUMENTS

| | | | |
|---|---|---|---|
| 4,272,333 | 6/1981 | Scott et al. | 205/144 |
| 5,441,820 | 8/1995 | Siu et al. | 429/17 |
| 5,635,051 | 6/1997 | Salas-Morales et al. | 205/602 |

OTHER PUBLICATIONS

F.J. Dudek, et al., "Recycling Zinc by Dezincing Steel Scrap," *Zinc & Lead '95*, Int'l Symposium on Extraction and Applications of Zinc and Lead, Sendai, Japan (May 1995), pp. 557–565.

*Primary Examiner*—Kathryn Gorgos
*Assistant Examiner*—Edna Wong
*Attorney, Agent, or Firm*—Townsend and Townsend and Crew LLP

[57] ABSTRACT

Zinc metal is deposited from an alkali electrolyte solution onto conductive seed particles in an electrowinning process which yields unusually high current efficiency and low energy consumption.

25 Claims, 6 Drawing Sheets

EFFICIENT ELECTROWINNING OF ZINC FROM ALKALINE ELECTROLYTES

BACKGROUND OF THE INVENTION

1. Field of the Invention

This invention resides in the fields of zinc electrowinning and particle bed electrolysis.

2. Description of the Prior Art

The final step in the production of zinc, following roasting and leaching, is electrowinning, in which aqueous zinc ion is electrolyzed to zinc metal at the cathode of an electrolytic cell while oxygen is liberated at the anode. One of the more efficient ways of electrowinning is the use of a particle bed electrode, and particularly a bed known as a "moving" or "moving packed" bed, as opposed to a stationary bed or a fluidized particle bed. In a moving bed, particle movement is maintained at a level that is high enough to prevent particle agglomeration, yet low enough to keep void space to a minimum and to keep at least most of the particles in contact with the current feeder. A disclosure of moving bed electrolysis is found in co-pending U.S. patent application Ser. No. 08/521,021, filed Aug. 30, 1995, now U.S. Pat. No. 5,635,051, entitled "Intense Yet Energy-Efficient Process for Electrowinning of Zinc in Mobile Particle Beds" (Salas-Morales et al.).

While the test data reported by Salas-Morales et al. was obtained with a sulfuric acid catholyte, the recovery of zinc from certain sources would benefit from an electrowinning process in which an alkaline catholyte is used rather than an acidic catholyte. Zinc-air batteries, for example, use an alkaline electrolyte, and an alkaline electrowinning cell would regenerate both the zinc particles and the alkaline electrolyte. Another example is the degalvanizing of (i.e., removal of zinc from) galvanized steel scrap, which is done by electrolytically aided leaching with hot caustic. This generates an alkaline zinc solution, from which zinc could be recovered directly if an alkaline electrowinning process were used.

Alkaline electrowinning of zinc with plate electrodes rather than particle bed electrodes results in the formation of a zinc powder rather than a layer of zinc on the cathode. This is because deposition of zinc from an alkaline solution results in the formation of dendrites on the cathode. The dendrites do not adhere well to the cathode and readily fall off in powder form. Neither agglomeration nor particle growth occur in the liberated powder, since deposition occurs on the cathode rather than on the powder. Use of this process was described by Dudek, F. J., et al. "Recycling Zinc by Dezincing Steel Scrap," An *International Symposium on the Extraction and Applications of Zinc and Lead*, Sendai, Japan, May, 1995. Zinc metal formed in this manner is difficult to wash and to melt because of its high surface area, and has a tendency toward dust formation.

Zinc deposition from an alkaline solution by use of a moving particle bed as the cathode is disclosed by Scott et al. in U.S. Pat. No. 4,272,333, issued Jun. 9, 1981. Scott et al. describe the depositions of copper, zinc, cobalt and manganese from various alkali, acidic and neutral solutions. The patent reports high current efficiencies (the amount of current used in reduction of the metal as a percentage of the total current consumed in the cell) together with energy consumption values that vary with the metal being deposited and the type of catholyte. In its data pertaining to zinc with an alkaline electrolyte, however, the patent reports current efficiencies of only 82–95%, and these efficiencies appear to drop as the initial zinc ion concentration increases. The energy consumption reported in these tests ranges from 2.5 to 3.4 kWh/kg, which is too high a range to be economically feasible, particularly when the recovered zinc is used in zinc-air batteries.

A moving bed electrowinning process conducted in an alkali electrolyte is therefore needed that will achieve high current efficiencies and achieve effective results with a low energy consumption. This and other limitations of the prior art are addressed by the present invention.

SUMMARY OF THE INVENTION

It has now been discovered that the poor results reported in the Scott et al. patent for electrowinning of zinc from an alkali electrolyte with a moving particle bed can be improved upon in an unexpected manner by the use of a counter electrode that is catalytic for oxygen generation, and by raising the zinc ion concentration in the electrolyte. Higher current efficiency and lower energy consumption that those disclosed by Scott et al. are both achieved, and even further improvements are achieved by adjustments of the current density, operating temperature, alkali concentration, and other parameters of the system. These improvements are particularly surprising in view of the trends, or lack of trends, shown collectively by the data presented by Scott et al.

Further features and advantages of the invention will be apparent from the description that follows.

DETAILED DESCRIPTION OF THE INVENTION AND PREFERRED EMBODIMENTS

Figure 1A:
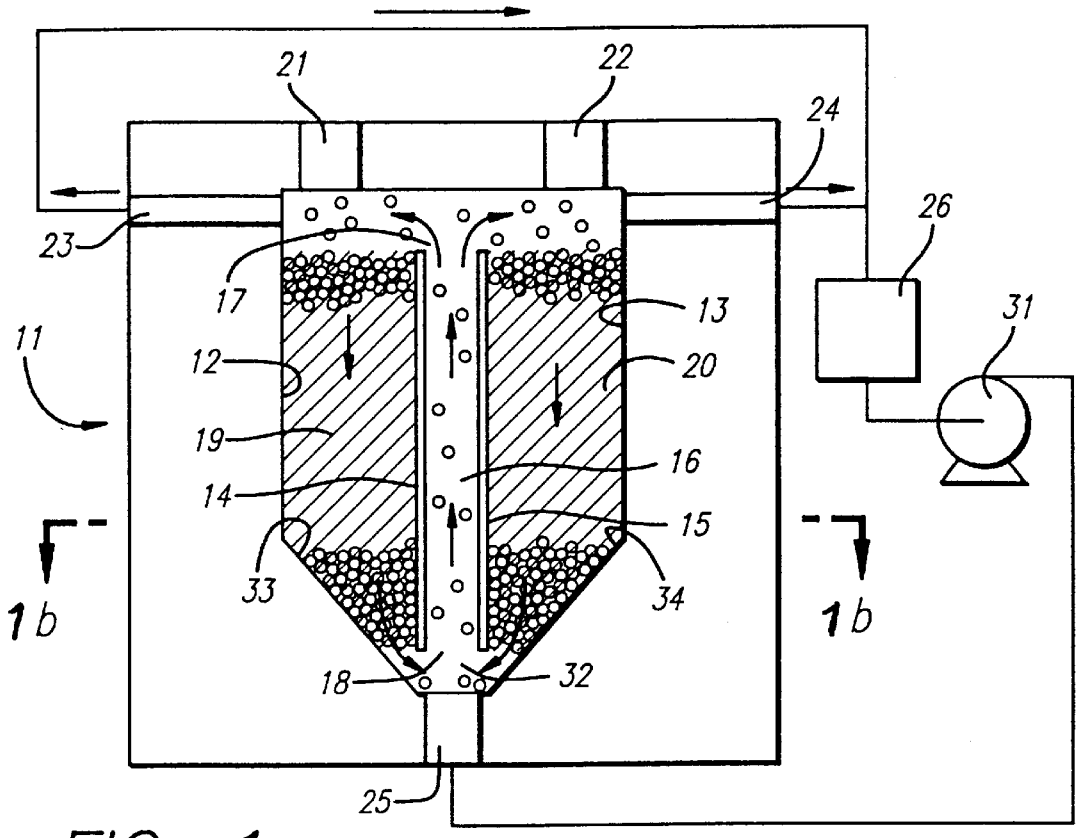
FIG. 1*a* is a side elevation in cross section of an electrolytic cell suitable for use in the practice of this invention.

The terms used in this specification are defined as follows:

The "current feeder" is a stationary solid electrified conductor immersed in the electrolyte solution and positioned to be struck by at least a portion of the zinc particles in the moving bed so that the potential on the conductor is transmitted to the particles. The potential on the current feeder is negative, thus causing the particles charged by it to function collectively as a cathode. Alternative terminology for the current feeder may be "current collector." In the absence of the particles, the current feeder would itself serve as the cathode.

The "counter electrode" is the anode.

The "gap width" is the distance between the current feeder and the ion-permeable diaphragm separating the current feeder and the counter electrode. In cell configurations in which the current feeder and diaphragm are not parallel, the term "gap width" is used to denote the distance averaged over the surfaces of the current feeder and diaphragm. For moving packed beds of particles, the gap width is equal to the bed thickness.

The "projected surface area" of either the current feeder or the counter electrode is surface area of a projection of either of these electrified elements on a plane parallel to the element. For flat plate elements, the projected surface area of one element is equal to the area of the side of that element facing the other element. For an element with a corrugated surface, the projected surface area is the area within the outline of the surface as projected onto a planar surface parallel to the central plane of the corrugated surface. For an element in the form of a planar mesh, the projected surface area is the area within the outline of the mesh as projected onto a continuous planar surface. The definition as applied to other examples will be readily apparent to those of skill in the art.

The "superficial current density" is the current passing through the cell divided by the projected surface area of the element having the largest projected surface area.

The "cell voltage" is the voltage difference between the current feeder and the counter electrode.

The "current efficiency" is the ratio, generally expressed as a percentage, of the actual zinc deposition rate to the rate which would be achieved if all of the current passing through the cell were consumed by reduction of zinc ion. The current efficiencies in zinc electrowinning cells are less than 100% because of the concurrent reduction of hydrogen ion competing with the zinc reduction at the cathode.

The "power consumption" or "energy consumption" is the amount of electrical energy consumed by the cell for each unit weight of zinc deposited. The amount of electrical energy consumed will also include electrical energy consumed by reactions competing with zinc reduction, such as hydrogen gas generation.

The counter electrode coating can be any coating material known in the art of electrochemical processing for increasing the rate of oxygen evolution. Examples are nickel mesh, platinum mesh, titanium diboride, and certain non-precious metals in the form of dimensionally stable anodes that are commercially available from industry suppliers. The term "dimensionally stable" denotes an anode material that is not consumed by the electrochemical reaction occurring at the anode. The underlying structural material for the counter electrode and for the current feeder as well can be any materials that are either typically used in the industry as cathodes and anodes, respectively, in a zinc electrowinning cell, or disclosed in the literature for such use. The current feeder can thus be aluminum, iron, steel, nickel, lead, combinations of these materials in the form of alloys or claddings, or other materials known to be useful as cathodes. The counter electrode can thus be lead, platinum, iron, nickel, platinum-iridium, combinations of these materials, or other materials known to be useful as anodes.

Improved results in accordance with this invention will be achieved when the initial concentration of zinc ion in the electrolyte solution is about 50 grams of zinc ion per liter of solution. A preferred range is about 50 g/L to about 500 g/L, and a more preferred range is from about 75 g/L to about 200 g/L. Deposition from the solution will generally be continued until sufficient metallic zinc has been deposited to render the process economically feasible. In most cases, deposition can be continued until the zinc ion concentration is reduced to about 30 g/L or less while still enjoying the benefits of the invention, and in preferred procedures, deposition is continued until the zinc ion concentration is reduced to about 10 g/L or less.

The alkali concentration in the electrolyte can vary, but in most cases, the most efficient results will be obtained with concentrations within the range of about 3N to about 20N. Preferred concentrations are those in the range of about 4N to about 10N, and most preferred are those in the range of about 4N to about 7N. The alkali is preferably an inorganic alkali, and more preferably an alkali or alkaline earth metal hydroxide. Metal hydroxides of particular interest are sodium and potassium hydroxide, with potassium hydroxide preferred.

The zinc ion can be introduced into the electrolyte solution as any zinc salt or compound that will dissolve in an aqueous alkali. Compounds that form zincates, i.e., $[Zn(OH)_3H_2O)]^-$, and $[Zn(OH)_4]^{2-}$, are particularly preferred. Examples of zinc compounds that can be used are zinc oxide, zinc cyanide, zinc halides, zinc carbonate, and zinc phosphate. Zinc oxide and other compounds that form zincates in aqueous alkali are the most preferred.

The temperature of the electrolyte during the deposition can vary. In most applications, best results will be obtained with temperatures within the range of about 30° C. to about 75° C. A preferred range is from about 30° C. to about 60° C., a more preferred range is from about 35° C. to about 50° C., and an even more preferred range is from about 40° C. to about 50° C.

The electrowinning cell used in the process of this invention is a flat spouted bed cell. In this type of cell, the moving bed is confined between a vertical flat plate current feeder and a vertical flat plate anode which form an enclosure with its short dimension (the gap width) substantially smaller than both the width and height of the enclosure. In preferred embodiments of the invention, the gap width is at least about 5 mm, more preferably from about 5 mm to about 50 mm, still more preferably from about 10 mm to about 30 mm, and most preferably from about 20 mm to about 25 mm.

Cells used in accordance with this invention will preferably include a diaphragm, membrane, or other ion-permeable barrier positioned between the current feeder and the counter electrode, either to separate the cell into anolyte and catholyte compartments and retain the particles in the catholyte compartment, or to shield the counter electrode from the particles. The barrier is preferably a neutral, non-ionized barrier, rather than a barrier such as an ion exchange membrane, and the barrier is preferably adjacent mounted to the counter electrode surface, shielding the electrode surface from the particles. Any chemically and electrically inert barrier materials may be used. Examples are porous plastic such as polytetrafluoroethylene, polyethylene, polypropylene, polycarbonate, cellulose and nylons. Membranes of these materials are commercially available under the trade names CELGARD® (Hoechst Celanese Corp., Charlotte, N.C., USA), MILLIPORE® (Gelman Sciences, Ann Arbor, Mich., USA), GORE-TEX® (W.L. Gore & Associates, Inc., Elkton, Md., USA), and NUCLEPORE® (Costar Scientific Corp., Pleasanton, Calif., USA).

Cell voltages in preferred implementations of this invention generally fall within the range of about 1.0 to about 5.0 volts, more preferably about 2.5 to about 4.0 volts, and most preferably about 3.0 to about 3.5 volts. Current densities preferably fall within the range of about 300 $A/m^2$ to about 2,500 A/m$^2$, and most preferably from about 500 A/m$^2$ to about 1,500 A/m$^2$.

During the operation of the cell, the majority of the particles in the cell are almost as densely packed as a stationary packed bed, and are moving downward under the influence of gravity. The particles are recycled to the top of the bed in a discrete levitation zone either outside or inside the cell by an upward stream of electrolyte solution pumped at a controlled rate. The levitation zone is preferably set off from the remainder of the cell volume by baffles or separating walls forming a draft tube.

The particles onto which the zinc is deposited from the electrolyte solution are particles of a solid conductive material, and the size can vary, depending on the other dimensions and parameters of the system and considerations of economy and efficiency. In most applications, the particles will have an initial number mean diameter of from about 0.2 mm to about 5.0 mm, preferably from about 0.2 mm to about 1.0 mm, and most preferably from about 0.3 mm to about 0.5 mm. The ratio of initial particle number mean diameter to gap width is preferably from about 0.003 to about 0.3, and most preferably from about 0.01 to about 0.1. While the seed particles can theoretically be any material capable of conducting electricity and serving as a cathode, for practical use of the process in the electrowinning of zinc, the seed particles will themselves be zinc as well.

Figure 1B:
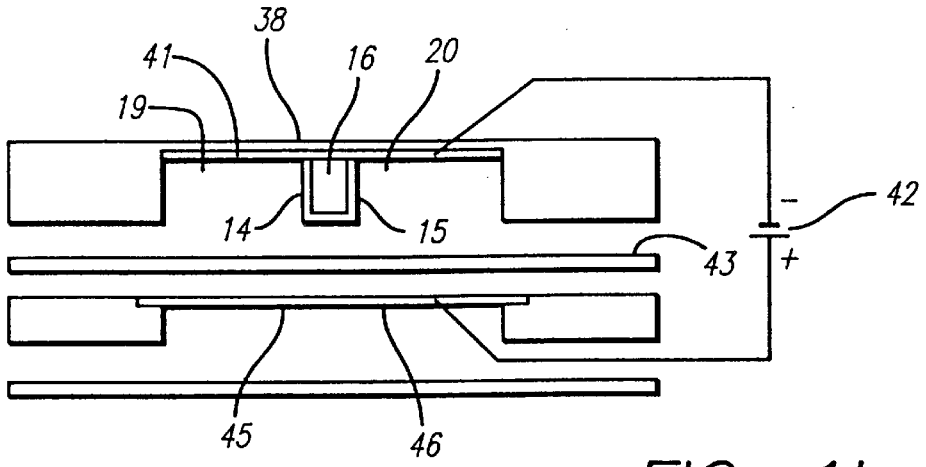
FIG. 1*b* is a cross section of the cell of FIG. 1*a*, taken along the line "b—b" of FIG. 1*a*.

An illustration of a simplified electrowinning cell for use in the practice of this invention appears in FIGS. 1*a* and 1*b*, The side elevation of FIG. 1*a* shows the interior of the cell 11 in cross section and the flow mechanics of the cell. The cell volume occupied by the electrolyte solution and particles is defined by side edge walls 12, 13 tapering toward the bottom, and contains internal partitions 14, 15 which divide the interior into a levitation zone or draft tube 16 open at both its upper end 17 and its lower end 18, and two downflow sections 19, 20. The cell contains openings 21, 22 at the top for adding seed particles, openings 23, 24 at the upper ends of the side edge walls to serve as catholyte outlets and an opening at the base 25 to serve as a catholyte inlet. A reservoir 26 holds excess catholyte, and an external catholyte pump 31 draws the catholyte from the reservoir 26 and directs it to the catholyte inlet 25.

The catholyte inlet 25 is aligned with the draft tube 16 such that incoming catholyte flows upward inside the draft tube, drawing with it any particles located in the region 32 at the base of the cell between the draft tube entry 18 and the catholyte inlet 25, as indicated by the upward arrow shown inside the draft tube. As the particles reach the top of the draft tube, they disperse laterally, falling into the downflow sections 19, 20, which are occupied by particles downwardly drifting in a more dense arrangement, i.e., a moving packed bed (represented by the parallel diagonal lines). The sloping lower ends 33, 34 of the side edge walls help maintain the packing density of the moving bed and prevent the occurrence of dead spaces in the particle and electrolyte flow. The flow rate or force of the catholyte spout or jet entering the draft tube determines how well the particles leaving the top of the tube will be dispersed over the top of the moving packed beds in the downflow sections 19, 20. In addition, the jet force can determine the proportion of catholyte being drawn off by the pump 31 relative to the total catholyte circulating through the draft tube 16, and hence the flow rate of the liquid electrolyte solution in the sections where the particles are flowing downward, as indicated by the downwardly directed arrows in FIG. 1*a*.

The electrical characteristics of the cell are shown in the cross section of FIG. 1*b* which is exploded front-to-back. The back wall 38 of the cell is coated or laminated with a surface layer 41 of a conductor extending across both the draft tube 16 and the downflow sections 19, 20. This conductor layer is connected to the negative pole of a power source 42 and thereby serves as the current feeder to the particles in the cell. A diaphragm 43 divides the cell into a catholyte compartment (which consists of the draft tube 16 and the downflow sections 19, 20 combined) and an anolyte compartment 45. An anode plate 46 in the anolyte compartment is connected to the positive pole of the power source 42. The particles are retained in the catholyte compartment.

The "gap width" referred to above is represented in the cell of FIGS. 1*a* and 1*b* by the distance between the current feeder 41 and the diaphragm 43. The "projected surface area" of the current feeder 41 and that of the anode 46 are essentially equal, and this area is the area outlined by the side edge walls 12, 13, 33 and 34 of the catholyte and anolyte compartments.

Figure 2:
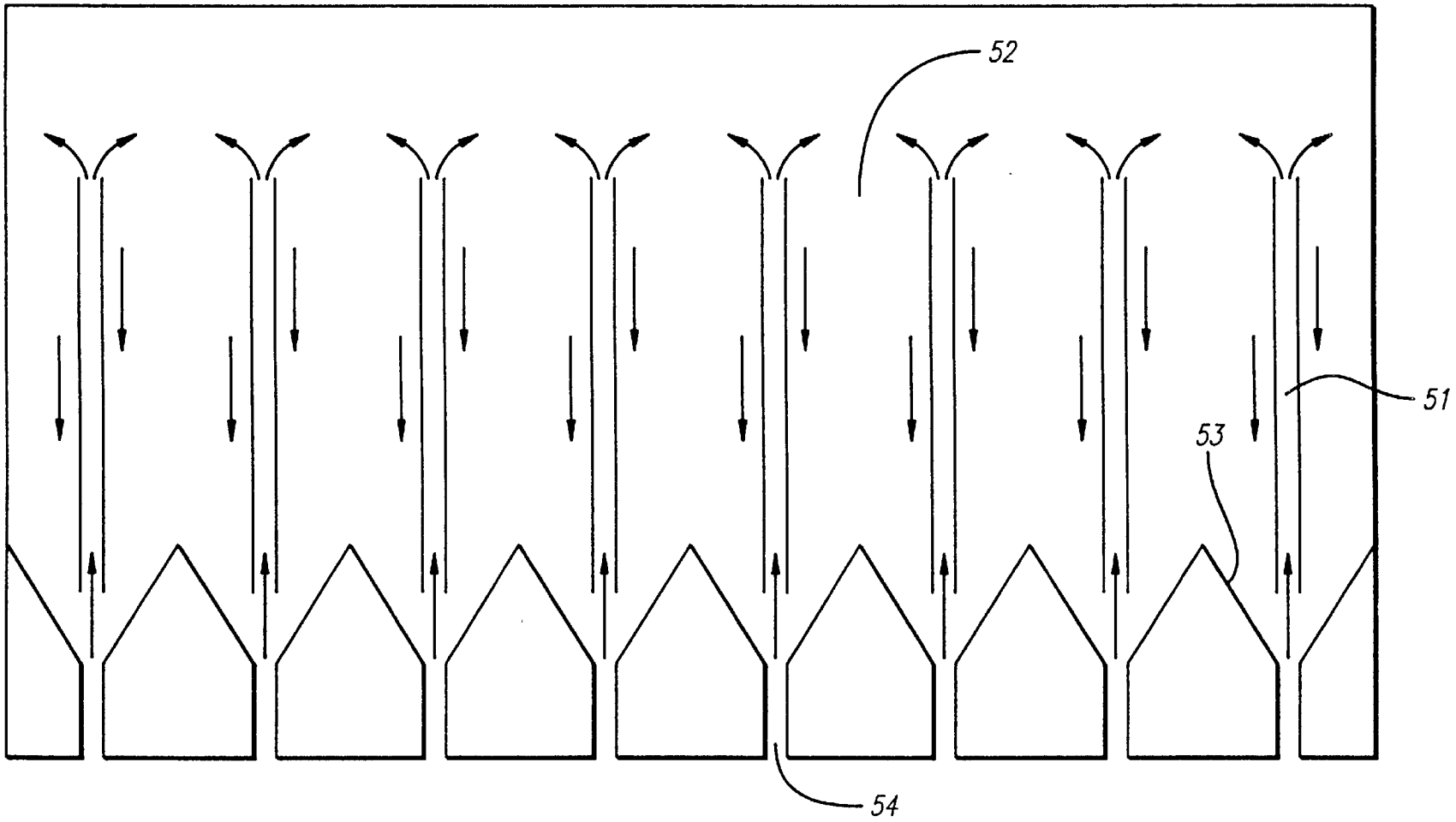
FIG. 2 is a side elevation in cross section of an additional electrolytic cell suitable for use in the practice of this invention.

A larger scale version of the flat spouted bed cell of FIGS. 1*a* and 1*b* is illustrated in FIG. 2, which is a side elevation cross section in the same view as that of FIG. 1*a*. Capacity in this cell is increased by increasing two dimensions, the horizontal dimension parallel to the current feeder and anode, and the cell height. This cell contains eight draft tubes 51, adjacent pairs of the tubes separated by downflow sections 52. The base of the cell chamber is formed from sloping wall sections 53 with catholyte inlets 54 at the junctures of their lower ends directly below the draft tubes 51. While the pump and power source used in conjunction with this cell are not shown in the drawing, they and the connections joining them to the cell are analogous to those shown in the cell of FIGS. 1*a* and 1*b*, The gap width is the same as that of the cell of FIGS. 1*a* and 1*b*, but the projected surface area and hence the current density are multiples of those of FIGS. 1*a* and 1*b*, The following examples are offered for purposes of illustration only.

In the experiments reported in the following examples, the configuration shown in FIGS. 1*a* and 1*b* was used. The gap width was 2.2 cm; the height of the parallel vertical side edges 12, 13 (referring to FIGS. 1*a* and 1*b*) to the top of the draft tube 16 was 10.0 cm); the height of the lower sloping edges 33, 34 (vertical component) was 7.8 cm; the vertical distance between the upper end 17 of the draft tube and the roof of the chamber was 5.9 cm; the distance between the vertical side edges 12, 13 at the top was 9.5 cm; the width of the draft tube 16 measured from its external surfaces was 1.5 cm; and the gap 32 between the lower end 18 of the draft tube and the catholyte inlet 25 was 3.3 cm. The current feeder was an aluminum layer; the anode was a nickel mesh with a coating of a dimensionally stable non-precious metal that was catalytic for oxygen evolution (obtained from The Electrolyser Corporation, Ltd., Toronto, Ontario, Canada); the diaphragm was a microporous plastic diaphragm (CELGARD® 5550, available from Hoechst Celanese Corporation, Separations Products Division, Charlotte, N.C., USA). The pump flow rate of catholyte was 2.3–2.6 gallons per minute.

The catholyte reservoir was filled with electrolyte prepared by dissolving zinc oxide in aqueous potassium hydroxide, using sufficient zinc oxide to achieve the desired dissolved zinc concentration as zincate ion. The anolyte reservoir was filled with an aqueous potassium hydroxide solution similarly prepared. Zinc seed particles were then added to the catholyte in the catholyte reservoir. All percents given are weight percents unless otherwise stated. All current densities are given as amperes per square meter of one side of the diaphragm.

EXAMPLE 1

A catholyte was prepared by dissolving 92 g/L of zinc (expressed as atomic zinc, but added in the form of zinc oxide) in 30% aqueous KOH, and adding 800 g of cut zinc wire whose length and diameter were both approximately 1.45 mm, while the anolyte was 30% aqueous KOH without zinc. The cell was operated at 35° C. and a current density of 1,000 A/m$^2$ of diaphragm. Energy consumption were determined by calculation from the cell voltage and current efficiency, and values of current efficiency were obtained by measuring hydrogen gas generation at the cathode. The results are plotted in FIG. 3, where the filled circles represent energy consumption, the open circles with center plus sign represent the cell voltage, and the open empty circles represent the current efficiency. Discontinuities in the data represent points in the experiment where the current was stopped and then restarted.

Figure 3:
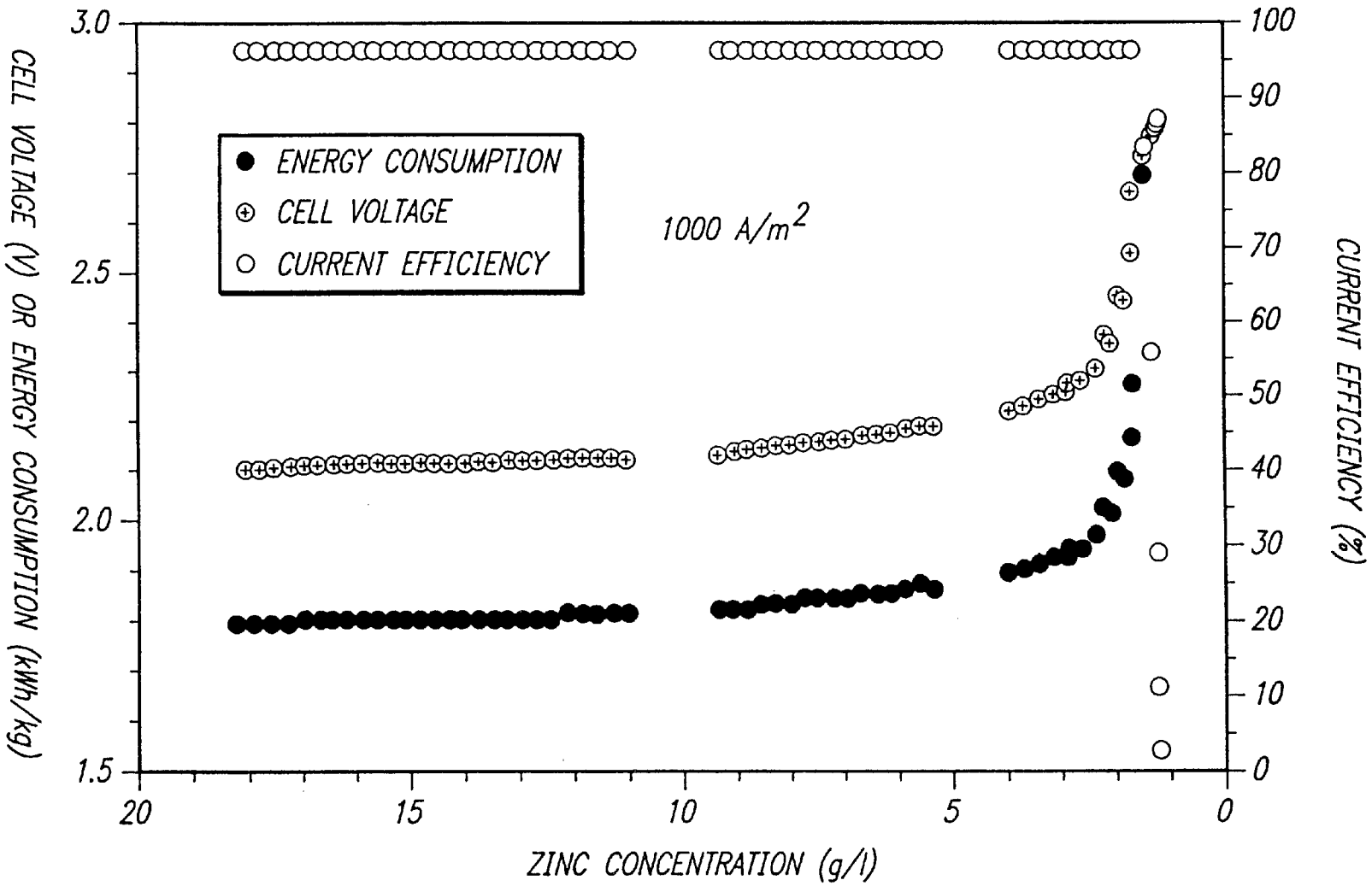
FIG. 3 is a plot of energy consumption, cell voltage, and current efficiency vs. zinc concentration in an electrowinning process in accordance with the invention.

The results shown in FIG. 3 indicate that the current efficiency remained close to 100% until the zinc concentration dropped to about 2 g/L, and the energy consumption remained well below 2.0 kWH/kg for approximately the same period of time.

EXAMPLE 2

Figure 4:
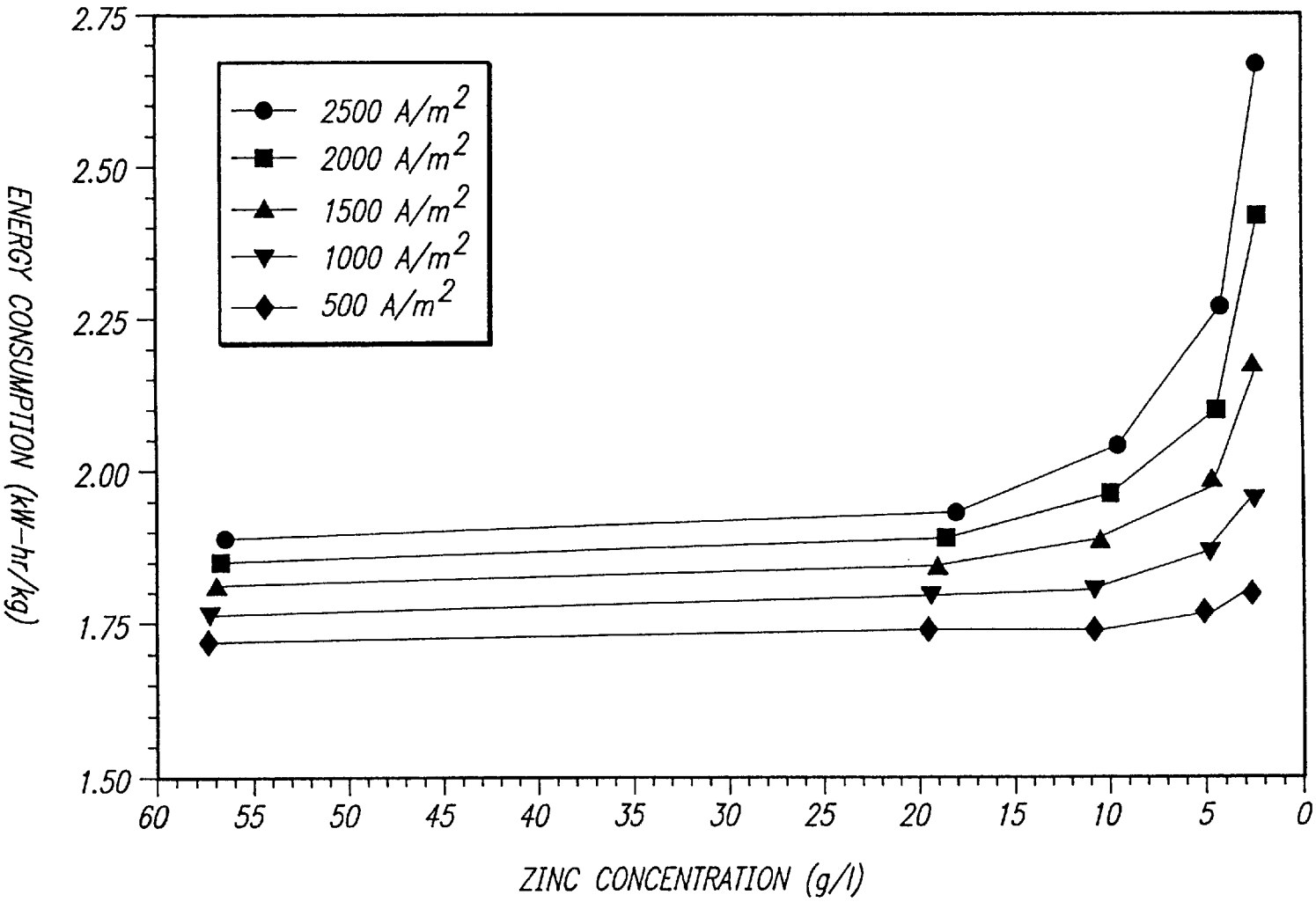
FIG. 4 is a plot of energy consumption vs. zinc concentration for current densities.

The performance of the cell under different current densities was determined by repeating the experiment of Example 1 with all of the experimental conditions listed therein except the current density, and instead using densities ranging from 500 A/m$^2$ to 2,500 A/m$^2$ in 500 A/m$^2$ increments. The energy consumptions are plotted in FIG. 4, where the filled diamonds represent data obtained at 500 A/m$^2$, the filled inverted triangles represent 1,000 A/m$^2$, the filled upright triangles represent 1,500 A/m$^2$, the filled squares represent 2,000 A/m$^2$, and the filled circles represent 2,500 A/m$^2$. The energy consumption rose as the current density increased, but at all current densities tested, the energy consumption remained below 2.0 kWh/kg until the zinc concentration dropped down to approximately 10 g/L.

EXAMPLE 3

Figure 5:
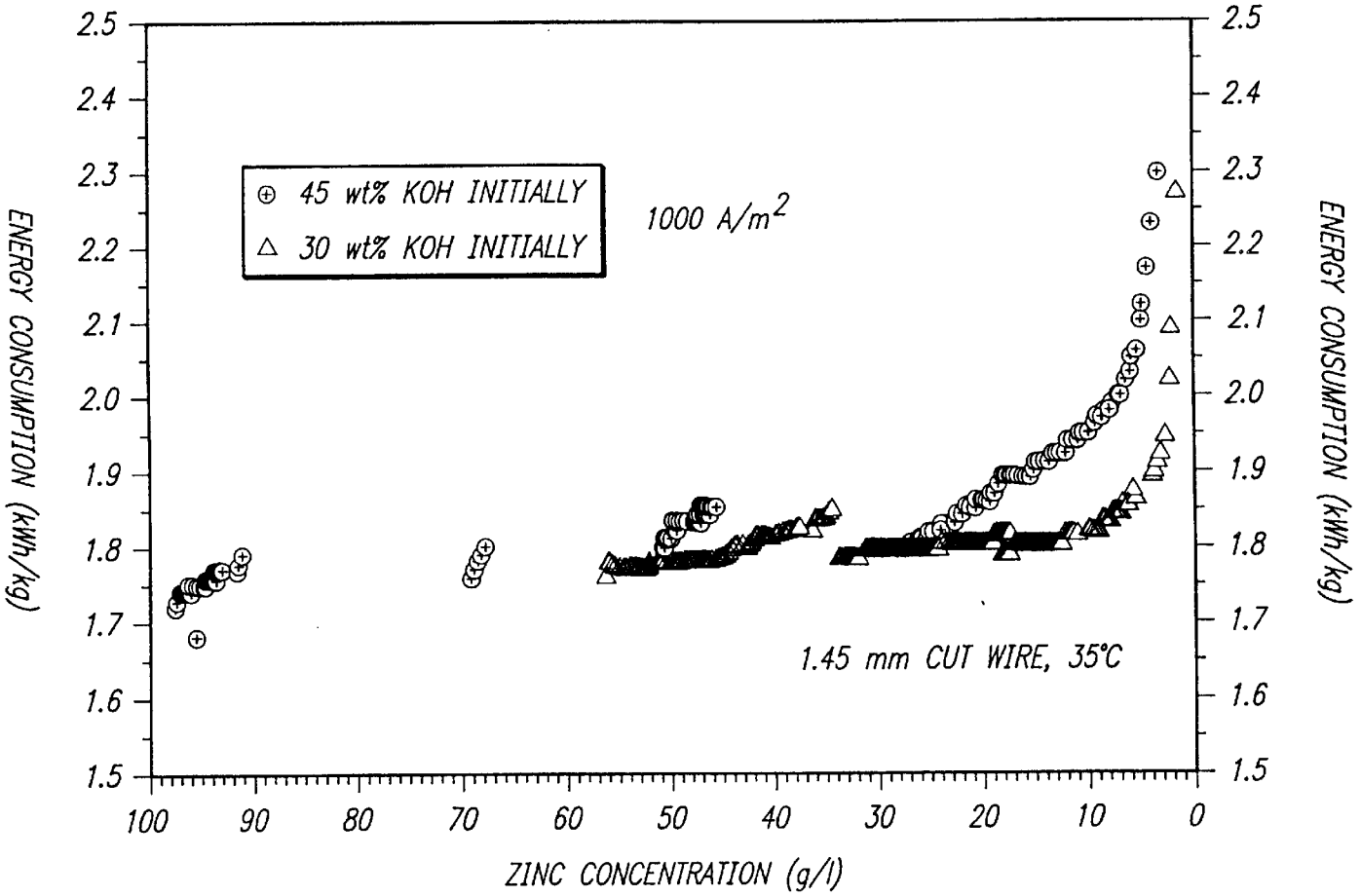
FIG. 5 is a plot of energy consumption vs. zinc concentration for strengths of alkali in the electrolyte.

The performance of the cell under different initial concentrations of KOH was determined by repeating the experiment of Example 1 twice under the same conditions listed in Example 1 except for the initial KOH concentration. In the first time trial, the initial KOH concentration was 30% and in the second the initial KOH concentration was 45%. The results are plotted in FIG. 5, where the triangles represent data taken with an initial KOH concentration of 30% and the circles represent data taken with an initial KOH concentration of 45%. In terms of energy consumption, the performance in each test was approximately the same until the zinc concentration dropped below 30 g/L, where the curves deviated with the curve representing 30% KOH giving superior results.

EXAMPLE 4

Figure 6:
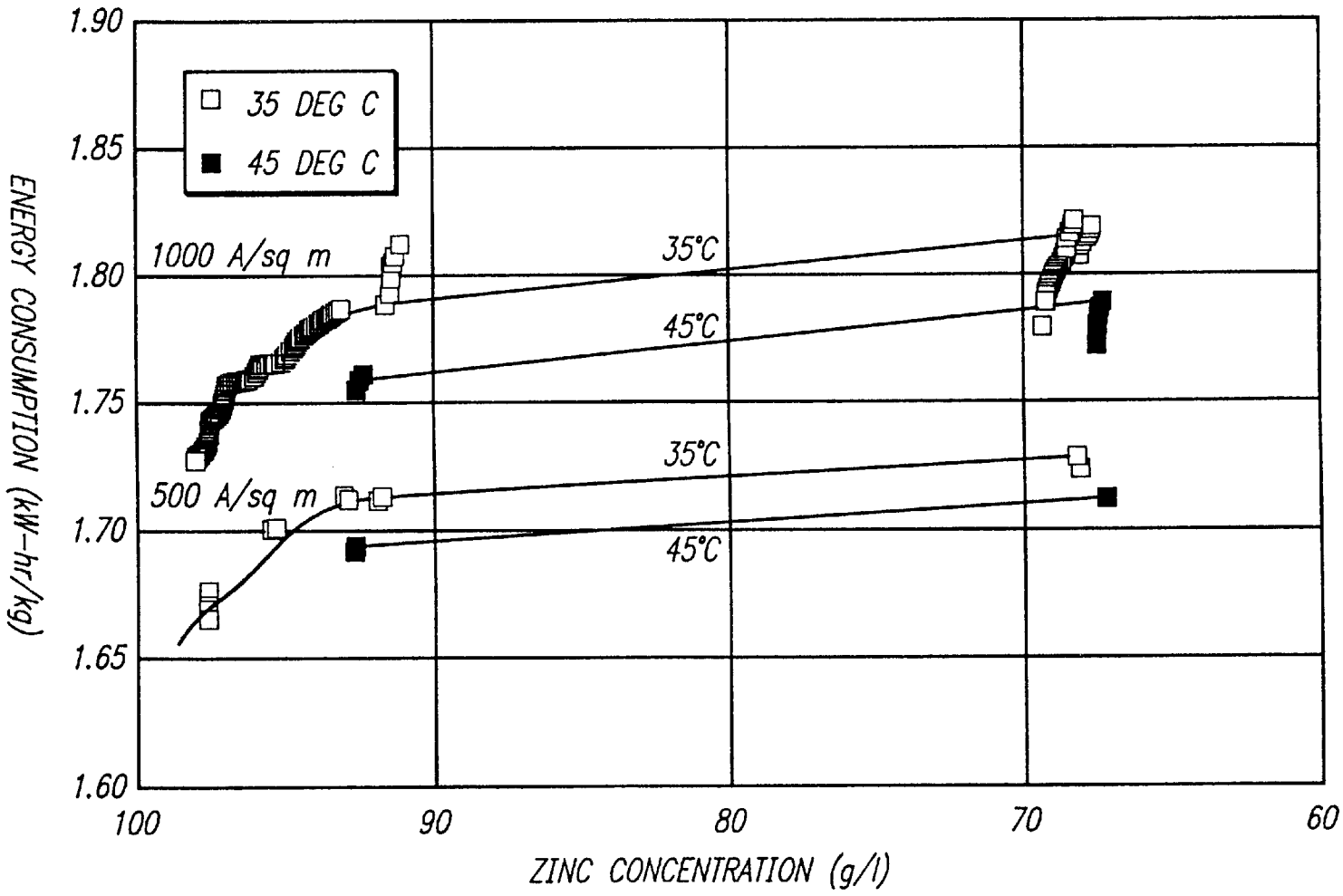
FIG. 6 is a plot of energy consumption vs. zinc concentration for different cell temperatures and current densities.

The effect of varying the temperature of the electrolytes was determined by repeating the experiment of Example 1 several times as follows: at 35° C. with current densities of 1,000 A/m$^2$ and 500 A/m$^2$, and at 45° C. with current densities of 1,000 A/m$^2$ and 500 A/m$^2$, each experiment performed with an initial KOH concentration of 45%, all other conditions being the same as those of Example 1. The results are plotted in FIG. 6, where the upper curve of open squares represents the run performed at 35° C. and 1,000 A/m$^2$, the lower curve of open squares represents the run performed at 35° C. and 500 A/m$^2$, the upper curve of filled squares represents the run performed at 45° C. and 1,000 A/m$^2$, and the lower curve of filled squares represents the run performed at 45° C. and 500 A/m$^2$. The curves show that the ten-degree increase in temperature reduced the energy consumption by 0.02–0.04 kWh/kg, the amount of reduction increasing with increases in the current density.

EXAMPLE 5

This example illustrates the use of the present invention in growing zinc seed particles by a factor of approximately 17 (increase in volume). The starting zinc particles consisted of 800 g of cut zinc wire with a number average diameter and length of 0.385 mm, and these were dispersed in a catholyte solution prepared by dissolving 45 g/L of zinc (expressed as atomic zinc, but added in the form of zinc oxide) in 30% aqueous KOH. The cell was operated at 35° C. and a current density of 2,500 A/m$^2$ of diaphragm, and the growth was discontinued when the particles reached approximately 1 mm in diameter.

A comparison of the particles before and after the experiment was made by electron micrography. The electron micrographs showed that the final particles were roughly spherical but well defined and all substantially equal in size. The surfaces of the particles were rough in appearance but the particles flowed freely. The cross section of a finished particle indicated a small degree of porosity, primarily restricted to regions lying within 0.150 mm of the particle surface.

The foregoing is offered primarily for purposes of illustration. It will be readily apparent to those skilled in the art that the operating conditions, materials, procedural steps and other parameters of the system and method described herein may be further modified or substituted in various ways without departing from the spirit and scope of the invention.

We claim:

1. A method for electrowinning metallic zinc from zinc ion in aqueous solution, said method comprising performing electrolysis on a mixture of solid conductive particles and aqueous alkali solution, said solution ranging in concentration from about 3N to about 20N alkali and containing dissolved zinc ion at an initial concentration ranging from about 50 to about 500 grams of zinc ion per liter of said solution, in an electrolytic cell containing first and second vertically arranged, parallel flat plates defined as a current feeder and a counter electrode, respectively, said counter electrode coated with a substance that is catalytic for oxygen evolution, said cell further containing an ion-permeable diaphragm parallel to each of said plates and interposed therebetween to define a gap between said current feeder and said diaphragm, by passing said mixture of particles and solution through said gap such that said particles contact said current feeder and passing a current across said gap, thereby depositing metallic zinc from said solution onto said particles.

2. A method in accordance with claim 1 in which said solution has an alkali concentration ranging from about 4N to about 10N.

3. A method in accordance with claim 1 in which said solution has an alkali concentration ranging from about 4N to about 7N.

4. A method in accordance with claim 1 in which said solution has an initial zinc ion concentration ranging from about 75 to about 200 g/L.

5. A method in accordance with claim 1 in which said solution has an initial zinc ion concentration ranging from about 75 to about 200 g/L, and said deposition is continued until said zinc ion concentration is less than about 30 g/L.

6. A method in accordance with claim 1 in which said deposition is performed at a current density of from about 300 $A/m^2$ to about 2,500 $A/m^2$.

7. A method in accordance with claim 1 in which said deposition is performed at a current density of from about 500 $A/m^2$ to about 1,500 $A/m^2$.

8. A method in accordance with claim 1 in which said deposition is performed at a temperature of from about 30° C. to about 75° C.

9. A method in accordance with claim 1 in which said deposition is performed at a temperature of from about 30° C. to about 60° C.

10. A method in accordance with claim 1 in which said deposition is performed at a temperature of from about 35° C. to about 50° C.

11. A method in accordance with claim 1 in which said deposition is performed at a temperature of from about 40° C. to about 50° C.

12. A method in accordance with claim 1 in which said alkali is potassium hydroxide.

13. A method in accordance with claim 1 in which said alkali is sodium hydroxide.

14. A method in accordance with claim 1 in which said gap is at least about 5 mm in width.

15. A method in accordance with claim 1 in which said gap is from about 5 mm to about 50 mm in width.

16. A method in accordance with claim 1 in which said gap is from about 10 mm to about 30 mm in width.

17. A method in accordance with claim 1 in which said gap is from about 20 mm to about 25 mm in width.

18. A method in accordance with claim 1 in which said diaphragm is a layer over the surface of said counter electrode.

19. A method in accordance with claim 1 in which said method comprises levitating said particles in a levitation region by an upward stream of said aqueous alkali solution and permitting particles thus levitated to settle in one or more settling regions between said current feeder and said diaphragm and adjacent to said levitation region.

20. A method in accordance with claim 1 in which said solid conductive particles have an initial number mean diameter of from about 0.2 mm to about 5.0 mm.

21. A method in accordance with claim 1 in which said solid conductive particles have an initial number mean diameter of from about 0.2 mm to about 1.0 mm.

22. A method in accordance with claim 1 in which said solid conductive particles have an initial number mean diameter of from about 0.3 mm to about 0.5 mm.

23. A method in accordance with claim 1 having a ratio of initial particle number mean diameter to gap width of from about 0.003 to about 0.3.

24. A method in accordance with claim 1 having a ratio of initial particle number mean diameter to gap width of from about 0.01 to about 0.1.

25. A method in accordance with claim 1 in which said particles are metallic zinc particles.

* * * * *